US005605315A

United States Patent [19]

Hartung et al.

[11] Patent Number: 5,605,315

[45] Date of Patent: Feb. 25, 1997

[54] ADJUSTABLE TREE STAND

[76] Inventors: Kenneth A. Hartung, Box 571 Rt. 5, Bedford, Pa. 15522; Michael R. Conrad, R.D. 5 Box 276, Altoona, Pa. 16602

[21] Appl. No.: 502,552

[22] Filed: Jul. 14, 1995

[51] Int. Cl.[6] ..... F16M 13/00

[52] U.S. Cl. ..... 248/523; 248/528

[58] Field of Search ..... 248/523, 519, 248/528, 524, 526, 527; 407/40.5

[56] References Cited

U.S. PATENT DOCUMENTS

| | | | |
|---|---|---|---|
| 2,537,826 | 1/1951 | Hauser | 248/524 |
| 4,699,347 | 10/1987 | Kuhnley | 248/516 |
| 5,362,024 | 11/1994 | Grinnen | 248/523 X |
| 5,375,808 | 12/1994 | Roy | 248/523 |

FOREIGN PATENT DOCUMENTS

| | | | |
|---|---|---|---|
| 96404 | 5/1960 | Norway | 248/523 |

*Primary Examiner*—Ramon O. Ramirez
*Attorney, Agent, or Firm*—Peter A. Borsari

[57] ABSTRACT

An adjustable tree stand for securing a tree in an upright vertical position comprising a tree bracket in the form of a V-channel having a lower rim for supporting the trunk of a tree, a central leg member and two side leg members which rotate on either side of the central leg member to form a tri-stand configuration, upper and lower leg-retaining plates securably mounted to the tree bracket for connecting the leg members thereto and a clamping mechanism having a clamping arm pivotally secured to one of said side leg members and engaging a locking means which is slidably mounted to the other of said side leg members.

14 Claims, 7 Drawing Sheets

ADJUSTABLE TREE STAND

FIELD OF INVENTION

The present invention relates to an adjustable tree stand for Christmas trees and the like which can be assembled quickly and easily and can accommodate tree trunks having variable and irregular diameters. The adjustable tree stand comprises a base assembly having means for receiving three leg members, two of which rotate on either side of the third leg member to form a tri-stand configuration, and a clamping mechanism comprising a clamping arm and locking means for maintaining the tree in a vertical position.

BACKGROUND OF THE INVENTION

During the period between the Thanksgiving and Christmas holidays, there is a flurry of activity as citizens begin to decorate homes, offices, stores and town squares in celebration of the holiday season. One of the most popular decorations is the Christmas tree. Families and friends travel to tree farms or drive to neighborhood merchants seeking to find an evergreen tree to bring home and decorate. Once a evergreen tree is brought home, it must be installed in a tree stand before it can be decorated and transformed into a Christmas tree. Installing the tree in a tree stand and positioning it in a vertically straight position, is one of, if not the most, arduous task confronting the Christmas celebrators. The present invention provides an adjustable tree stand which enables the user to quickly and easily install and maintain an evergreen tree in a fixed, upright position.

One of the most conventional and widely used Christmas tree stands found in stores today is of the type which combines a water bowl with means to secure the tree. Typically, the water bowl has four legs and means for threading bolts through the rim of the bowl, the tops of the legs and into the trunk of the tree. Usually, the user of these devices must position the tree in the bowl and either hold the tree with one hand or have a second person hold the tree, while the user slowly rotates the bolts into the tree trunk. Since most tree trunks have irregular surfaces, one simply cannot equally rotate each bolt into the tree trunk. Rather, with these devices, it is common to rotate each one the bolts partially into the trunk of the tree, step back and observe whether the tree is standing upright, adjust the bolts, observe the tree again, further adjust the bolts until the tree finally is in the desired position, then tighten the bolts. Needless to say, this installation can be difficult, time-consuming and very frustrating. Moreover, the water bowl type stand is offered in several sizes to accommodate different diameters of tree trunks; thus the diameter of the trunk must be matched to the corresponding stand.

There have been numerous attempts in the prior art to provide adjustable tree stands. Early efforts include, for example, U.S. Pat. No. 2,441,473 to Davis which discloses a simply tree stand having a pair of vertically disposed cross-arms removably secured together to form two sides of a triangle and slotted to received a tapered wedge which forms the third side of the triangle. A tree trunk is positioned between the two cross arms and held in place by sliding the wedge against the tree. In U.S. Pat. No. 2,786,641 to Applegate, a stand is provided for supporting a Christmas tree in an upright position comprising a base portion having an upwardly tapering pin in the center thereof and three legs attached to the underside thereof. The three legs rotate about the base and can be pivoted outwardly to form a tri-stand configuration. A central hole is drilled or bored into the bottom of the trunk conforming to the size of the tapered pin for securing the tree to the base. Neither Davis nor Applegate provide any means for clamping or otherwise securing the tree in an upright position, thus increasing the likelihood that the tree could fall.

U.S. Pat. No. 2,639,877 provides a Christmas tree stand comprising separable sections held together by an adjustable clamp. One of the separable sections is designed to receive the offset end of a clamping arm. The clamping arm extends to a point adjacent to the intersection point of the two sections, with the free end of the clamp extending outwardly. When the clamp is forced into contact with a tree trunk positioned between the two sections, the tree trunk is locked into an upright position.

U.S. Pat. No. 4,699,347 to Kuhnley discloses a tree stand having a circular ring base. Extending upward from said base, in a tripod arrangement, are three legs. Two legs are contained in a double legs assembly which are hingedly attached at two brackets on the ring base, by two pins. The third leg is removably attached to a bracket on the ring base by a removable pin. The device further includes a clamp arm which is hingedly connected to the socket leg. The clamp arm, which may be serrated, is spring-based in order to apply pressure against the trunk when the clamp is pushed downward to help the tree trunk in position.

In U.S. Pat. No. 5,375,808 to Roy, a Christmas tree stand is provided having a jaw assembly with a bottom for slidably engaging a tree trunk and an adjustable locking bar, located above the bottom of the jaw assembly, for forcibly clamping the trunk laterally between the bar and jaw assembly. Roy's jaw assembly does not provide means for controlling the rotation of the leg members, nor does it provide any means for locking the leg members in place.

Despite the teachings of the prior art, a need still exists for an adjustable tree stand which can accommodate trees of various diameters and irregular surfaces and safely hold larger trees. Such a tree stand should be capable of being assembled quickly and efficiently. Additionally, such a tree stand should enable the user to easily position a tree therein and clamp and secure the tree in an upright position. The tree stand also should be lightweight and designed for compact storage.

SUMMARY OF THE INVENTION

Accordingly, it is an object of the present invention to provide an adjustable tree stand which can support trees of different diameters and irregular surfaces in a safe manner.

It is another object of the present invention to provide an adjustable tree stand which can be assembled quickly and easily.

It is still another object of the present invention to provide an adjustable tree stand which can hold larger trees safely.

It is an additional object of the present invention to provide an adjustable tree stand in which a tree can be installed and secured by one person.

It is a further object of the present invention to provide an adjustable tree stand which enables a person to adjust the vertical position of the tree with minimal effort.

It is still another object of the present invention to provide an adjustable tree stand having means to clamp and lock the tree in an upright position.

It is a still a further object of the present invention to provide an adjustable tree stand which can be folded for compact storage.

Additional objects, advantages and novel features of the invention will be set forth in part of the description and claims which follow, and in part will become apparent to those skilled in the art upon examination of the following specification or may be learned by practice of the invention.

These and other objects of the invention, as embodied and broadly described herein, are achieved by providing an adjustable tree stand comprising a tree bracket having means for receiving three leg members, two of which rotate on either side of the third leg member to form a tri-stand configuration, means for supporting the tree in a vertical position and a locking means for maintaining the tree in a vertical position.

BRIEF DESCRIPTION OF THE DRAWINGS

The present invention will be better understood with reference to the appended drawing sheets, wherein.

DETAILED DESCRIPTION

The present invention relates to an adjustable tree stand for use with Christmas trees and the like which can secure and retain trees having variable and irregular diameters. The adjustable tree stand comprises a tree bracket, a central leg member and two side leg members connected to said tree bracket by means of leg-retaining plates and a clamping mechanism comprising a clamping arm and a locking means for securing the tree in an upright position.

Figure 1:
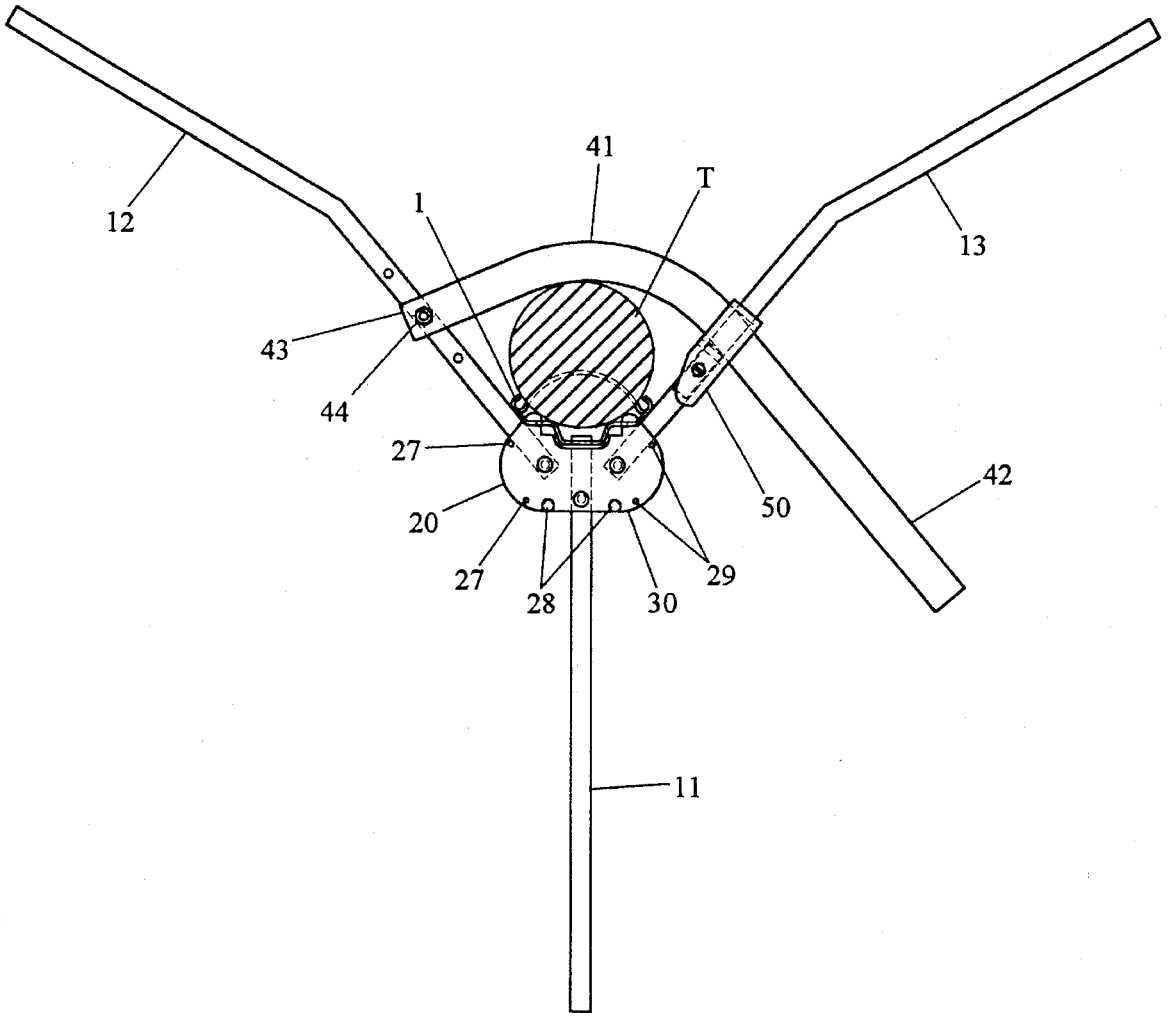
FIG. 1 is a top view of the adjustable tree stand having a tree trunk clamped therein.

FIG. 1 shows a top view of the adjustable tree stand having a tree trunk T securably retained therein and comprising (a) a tree bracket 1, (b) a central leg member 11 and two side leg members 12 and 13 which rotate on either side of said central leg member, (c) upper and lower leg-retaining plates 20 and 30, respectively and (d) a clamping mechanism 40 comprising a clamping arm 41 mounted to one of said side leg members and engaging a locking means 50 which is fastened to the other of said side leg members. Optionally, the tree stand can be provided with means to restrict the movement of side leg members 12 and 13. In one embodiment, means 27, 28, 29 can be in the form of apertures which are configured to receive pins. In this manner, the rotation of side leg members 12 and 13 is limited to the area between the apertures 27 and 29 respectively. To set the side leg members in an open position, each side leg member is rotated and extended past the respective outer apertures and pin are inserted in said outer apertures to "lock" each side leg member in the open position. Means 28 is provided in order to "lock" the side leg members in a closed position next to central leg member 11. In a second embodiment shown in FIGS. 3A and 3B, blisters are provided to control the rotation of the side leg members.

Figure 2:
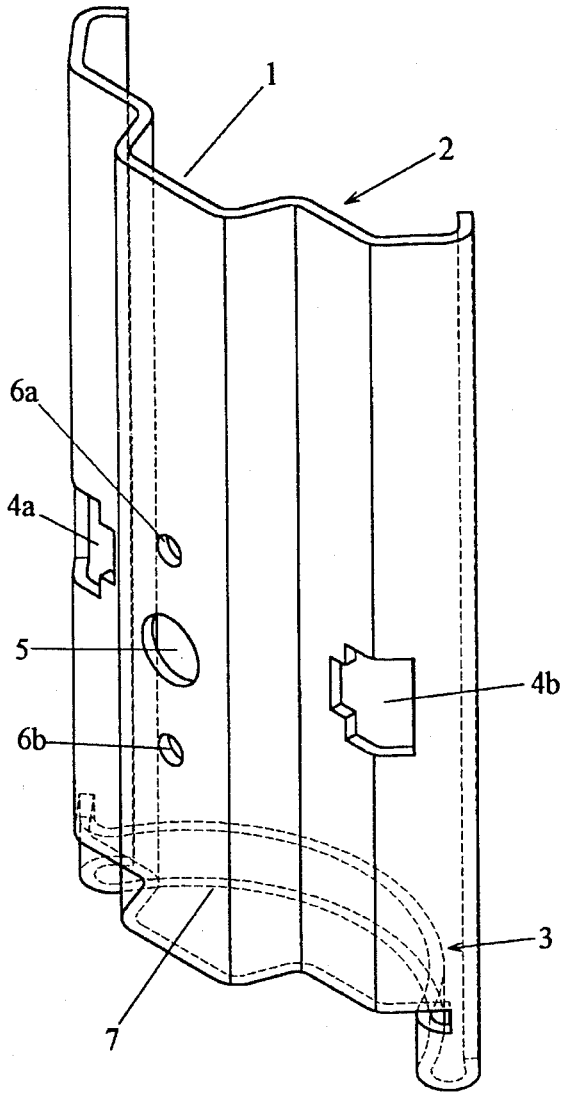
FIG. 2 is a perspective side view of the tree bracket of the adjustable tree stand.

Referring to FIG. 2, the tree bracket 1 is configured in the form of a V-channel such that the inner surface 2 partially encircles the tree trunk T and comprises a rim 7 extending outwardly from the lower end 3 of inner surface 2 to support the tree trunk T. Preferably, rim 7 extends outwardly from the tree bracket at a position slightly above the lower end 3 such that a water bowl or similar watering device can be placed underneath the trunk T. Disposed within the tree bracket 1 are means for receiving and supporting the leg-retaining plates 20 and 30. Preferably, the means for receiving and supporting the leg-retaining plates 20 and 30 are complementary side notches 4*a* and 4*b*. Also disposed within the tree bracket 1 is a central aperture 5 for receiving a central leg member 11, as well as apertures 6*a* and 6*b* for securing the leg-retaining plates 20 and 30 to said tree bracket.

Figure 3A:
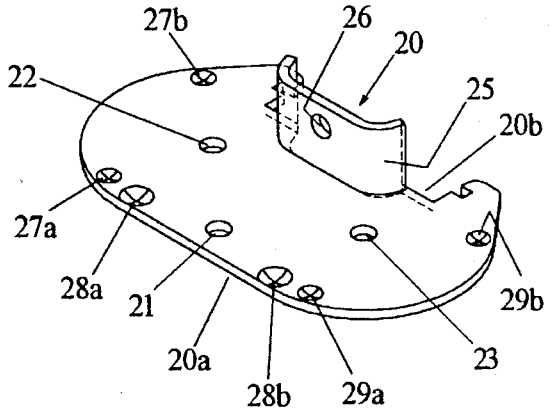
FIG. 3A is a perspective view of the upper leg-retaining plate.
Figure 3B:
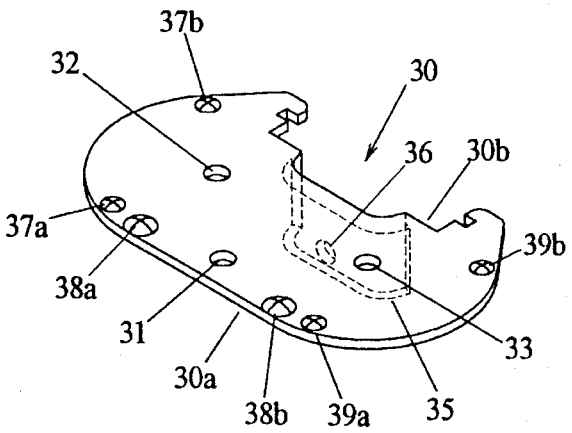
FIG. 3B is a perspective view of the lower leg-retaining plate.

FIGS. 3A and 3B illustrate the upper and lower leg-retaining plates 20 and 30 respectively. Referring to FIG. 3, the upper leg-retaining plate 20 is in the form of a flat plate comprising a front straight edge 20*a*, a notched rear edge 20*b* and a curved annular flange or bracket 25 extending upwardly at a 90° angle from said notched rear edge 20*b*. Disposed within the bracket 25 is an aperture 26 which is configured to cooperate with aperture 6*a* of said tree bracket. Apertures 21, 22 and 23 are provided within the surface of the retaining plate 20 for securing central leg member 11 and side leg members 12 and 13 respectively. As noted above, in the alternate second embodiment, complementary pairs of nodes or blisters 27*a* and 27*b*, 28*a* and 28*b* and 29*a* and 29*b* are positioned about the periphery of the undersurface of the retaining plate 20.

The lower leg-retaining plate 30 is identical to the upper leg-retaining plate 20. More particularly, as shown in FIG. 3B, the lower leg-retaining plate 30 is in the form of a flat plate comprising a front straight edge 30*a*, a notched rear edge 30*b* and a curved annular flange or bracket 35 extending downwardly at a 90° angle from said plate 30 at the notched rear edge 30*b*. Disposed within the bracket 35 is an aperture 36 which is configured to cooperate with aperture 6*b* of said tree bracket. Apertures 31, 32 and 33 are provided within the surface of the retaining plate 30 for securing central leg member 11 and side leg members 12 and 13 respectively. Positioned about the periphery of the upper surface of the retaining plate 30 are complementary pairs of nodes or blisters 37*a* and 37*b*, 38*a* and 38*b* and 39*a* and 39*b*.

Figure 4:
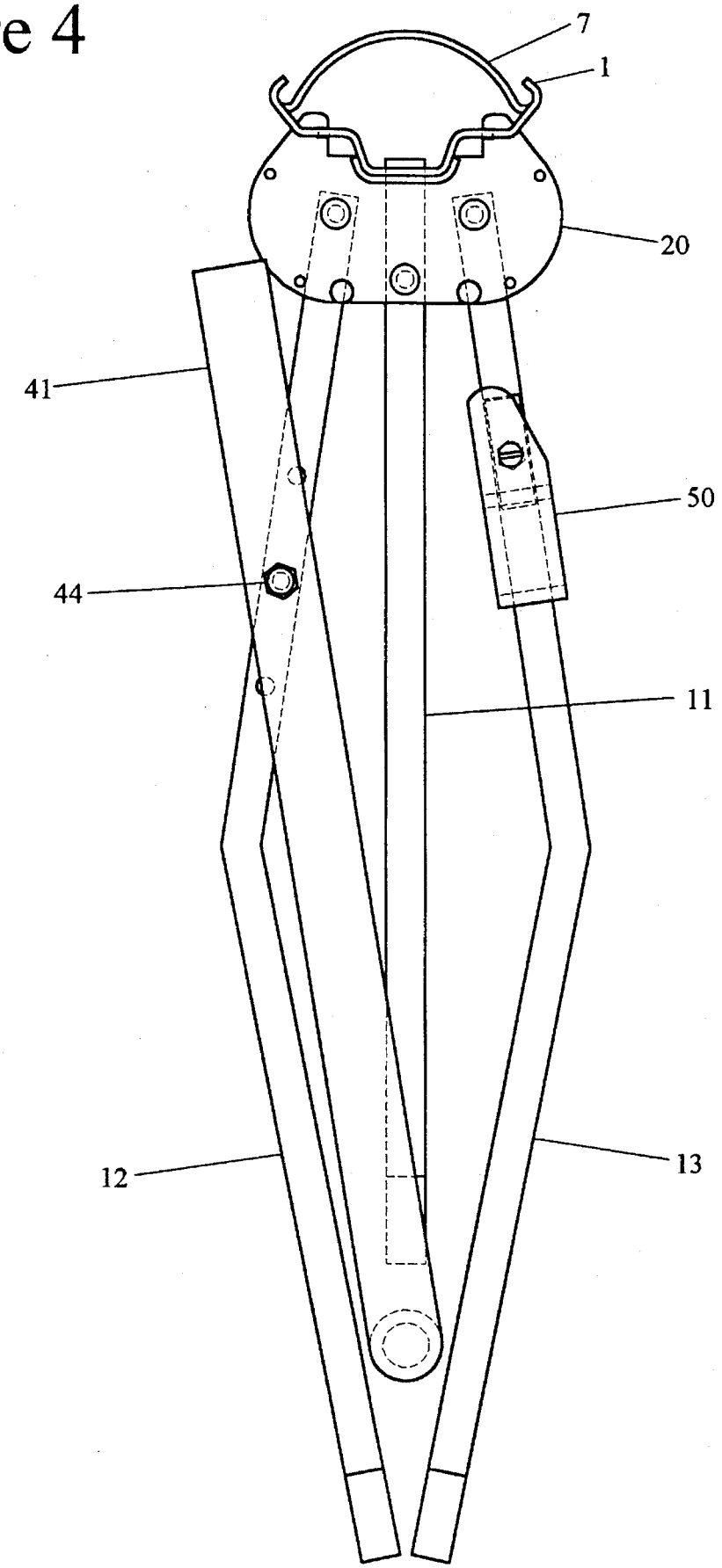
FIG. 4 is a top view of the adjustable tree stand in a folded position.

As best seen in FIGS. 1 and 4, central leg member 11 and side leg members 12 and 13 are constructed of a tubular material, for example, hollow metal tubings. However, it is to be understood that any suitable material may be utilized in constructing the leg members as long as the material is sturdy and can support the weight of a tree without collapsing. Means are provided at one end of each leg member for securing said leg member to the upper and lower leg-retaining plates. Referring to the central leg member 11, said means preferably is an aperture drilled through the cross section of the central leg member complementing apertures 21 and 31 provided in the retaining plates 20 and 30 respectively. In this manner, a rivet, bolt or similar device can secure the central leg member between the two leg-retaining plates. Preferably, similar means for securing the side leg members 12 and 13 to the leg-retaining plates is employed. Each leg member is angled or bent and is tapered downward and away from the retaining plates such that the far end of each leg member rests on the floor.

Figure 5:
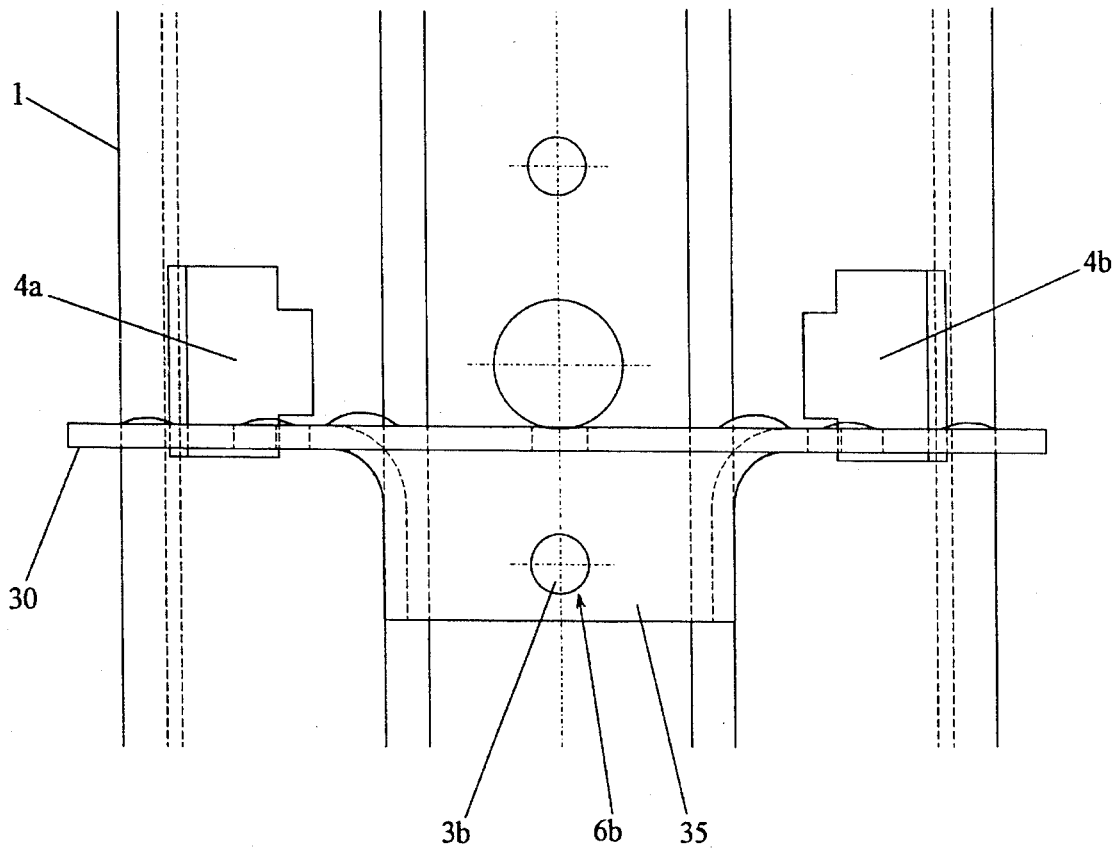
FIG. 5 is a side view of the lower leg-retaining plate positioned in tree bracket.

As shown in FIG. 5, to assemble the adjustable tree stand of the present invention, the notched rear edge 30*b* of the lower leg-retaining plate 30 is introduced into side notches 4*a* and 4*b* of tree bracket 1 and guided downward such that the aperture 36 of annular flange or bracket 35 is aligned with aperture 6*b* disposed in the tree bracket. Once the apertures are so aligned, a rivet, bolt or similar device is inserted in the apertures in order to securely fasten the retaining plate to the tree bracket. In a similar manner, upper leg-retaining plate 20 in introduced and secured to the tree bracket.

Figure 6:
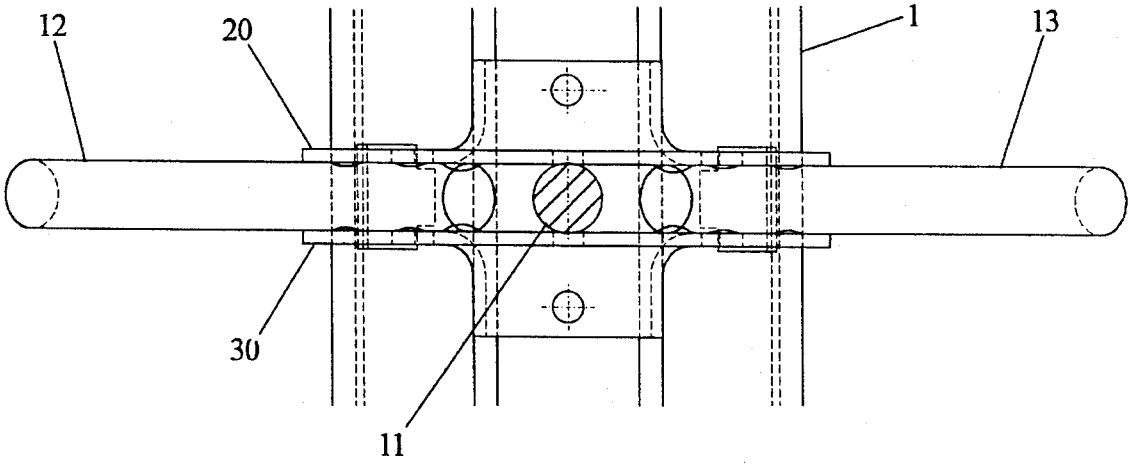
FIG. 6 is a side view of the adjustable tree stand.

As best seen in FIGS. 1 and 6, the central leg member 11 is introduced between upper leg-retaining plate 20 and lower leg-retaining plate 30 and into aperture 5 of the tree bracket such that the aperture in central leg member 11 is aligned with apertures 21 and 31 of leg-retaining plates 20 and 30 respectively. A bolt, rivet or similar device is inserted through the aligned apertures to secure the central leg member 11 to the tree bracket, thus preventing movement of central leg member 11.

Side leg member 12 is introduced between upper leg-retaining plate 20 and lower leg-retaining plate 30 such that the aperture in side leg member 12 is aligned with apertures 22 and 32 of leg-retaining plates 20 and 30 respectively. A bolt, rivet or similar device is inserted through the aligned apertures to connect the side leg member 12 to the tree bracket. Side leg member 12 is positioned between the blister pair 27*a* and 27*b* disposed on the undersurface of plate 20 and the blister pair 37*a* and 37*b* on the upper surface of plate 30. In this manner, the side leg member 12 freely rotates between blister set 27*a*/37*a* and blister set 27*b*/37*b*. To set leg member 12 in the open position, the leg member 12 is rotated outwardly to blister set 27*b*/37*b* and forced past the blister set, thereby "locking" the side leg member 12 against the tree bracket 1. Leg member 12 can be rotated to the closed position by forcing it past the blister set 27*b*/37*b* to the blister set 27*a*/37*a* and forcing it past this latter blister set, thereby "locking" side leg member 12 in the closed position. In a similar manner, side leg member 13 is connected to the tree bracket, freely rotates between the blister sets 29*a*/39*a* and 29*b*/39*b*, and is locked in the closed and open positions by forcing the side leg member 13 past blister sets 29*a*/39*a* and 29*b*/39*b*, respectively.

Once the trunk T is positioned against the inner surface 2 of the tree bracket 1, the trunk is held in place by a clamping mechanism 40. In the embodiment shown in FIG. 7, the clamping mechanism 40 comprises a clamping arm 41 which is pivoted at the mid point of one of the side leg members and rotated against the truck T. Preferably, the clamping arm 41 is constructed of a tough plastic material having a spring like characteristic such that it is flexible and can be bent into an arc under sufficient pressure. As shown in FIG. 1, the clamping arm 41 comprises a first end 43 which is secured to side leg member 12 by means of a bolt 44 or any other suitable means about which the arm 41 can rotate. The arm 41 extends through a ratchet-type lock 50 (hereinafter referred to as the "ratchet lock" or simply "the lock") which is slidably mounted on the side leg member 13. In this manner, the far end 42 of the clamping arm functions as a hand lever and hereinafter may sometimes be referred to as the "hand lever". As the hand lever is rotated about bolt 44 towards central leg member 11, the ratchet lock 50 slides up the tapered leg member 13 until the arm 41 contacts the trunk T.

Figure 7:
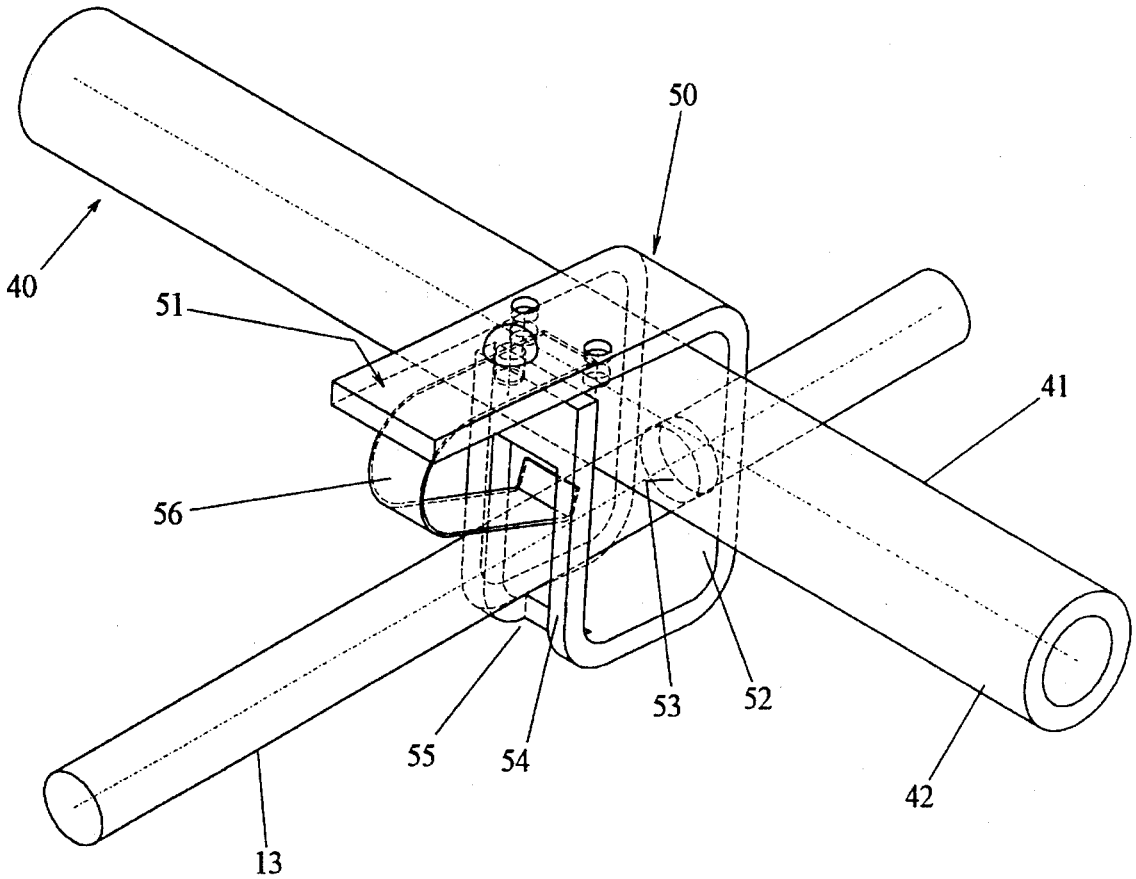
FIG. 7 is a perspective view of the ratchet lock of the adjustable tree stand.

The clamping arm is prevented from sliding down the tapered leg member 13 and away from the trunk T by the ratchet lock 50. Referring to FIG. 7, the ratchet-type lock 50 is in the form of a "P" shape having a long leg 51 which has a flat spring 56 attached thereto, a top leg 52 and a bottom leg 54. The top leg 52 is fabricated with a center hole 53 having a diameter slightly larger that the diameter of leg member 13 and the bottom leg 54 which is fabricated with a central slot 55. With this design, the lock 50 can slide easily along the leg member 13 inwardly, towards the trunk T and outwardly, away from the trunk, about the center line of hole 53. As the hand lever 42 is pulled inwardly against the trunk T, it pushes against the lock 50, thereby enabling the lock 50 to slide inwardly towards the trunk. The flat spring 56 exerts a force which is counter and equal to the force created by the hand lever causing the center line of the hole 53 to align with the center line of leg member 13. With these center lines so aligned, the lock 50 freely slides inwardly on leg member 13. As the flexible hand lever 42 is pulled inwardly, it contacts and curves about the trunk T. Continued inward pressure is applied until the flexible hand lever 42 securely holds the trunk T in an upright position. At his point, the hand lever 42 is released and exerts sufficient outward force to cause the lock 50, in concert with flat spring 56, to rotate and slide outward until the hole 53 contacts the leg member 13, thereby causing the ratchet lock 50 to wedge tightly on leg member 13. With the lock 50 wedged on leg member 13, the hand lever 42 is prevented from any additional outward sliding and the trunk T is locked securely in place. To release the trunk from the stand, pressure is exerted on the long leg 51 of the lock 50, such as by the hand or foot, in order to rotate the lock 50 forward and align the center lines of hole 53 and leg member 13, thereby enabling the lock 50 to slide freely over the leg member 13.

Figures 8A, 8B:
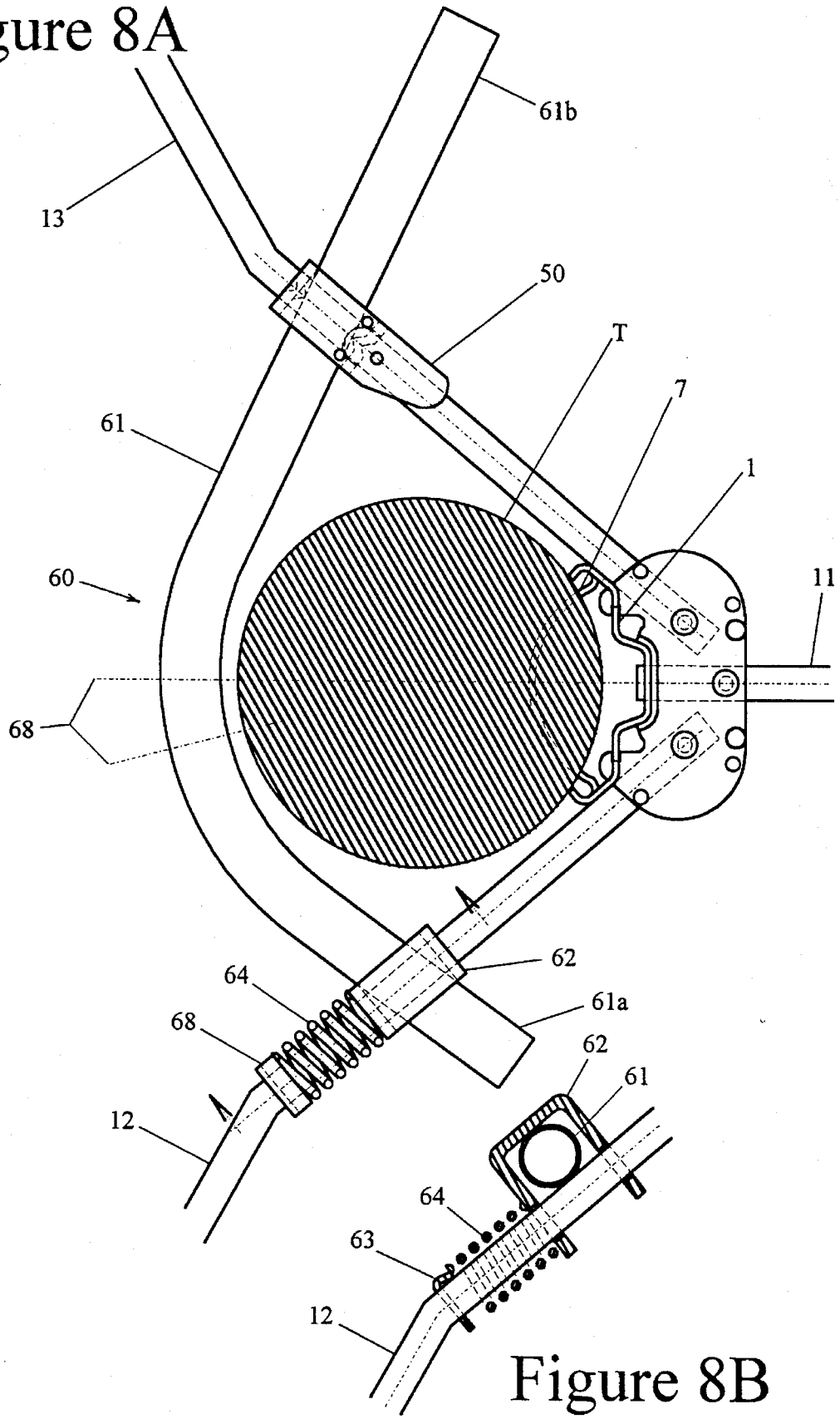
FIG. 8A is a top view of an alternate clamping means.
FIG. 8B is a side view of the sliding clevis arrangement.

FIGS. 8A and 8B show an alternate embodiment of the clamping mechanism. Referring to FIG. 8A, the clamping mechanism 60 comprises a sliding angle bar 61, a U-shaped sliding clevis 62, a movable anchor plate 63, a spring 64 and the locking means 50. The sliding angle bar 61 is composed of a rigid steel tube having ends 61*a* and 61*b* and is configured with an obtuse angle or arc 68. Disposed within the slidable clevis 62 are openings such that the clevis can be slidably mounted over side leg member 12. End 61*a* of the clamping arm also is slidably mounted within the loop of clevis 62 as shown in FIG. 8B. Compression spring 64 is fitted over leg member 12 and held in place by anchor plate 63. In this manner, clevis 62 is positioned against said spring and anchor plate. End 61*b* of the clamping arm passes through locking means 50 in the same manner as described above.

The initial positioning of the clamping bar 61 slidably mounted at ends 61*a* and 61*b* to side leg members 12 and 13 respectively, allows a trunk T to be placed onto rim 7 against tree bracket 1. As the end 61*b* of said clamping bar is pulled inwardly toward said tree bracket, locking means 50 slides inward over leg 13 until bar 61 contacts the tree trunk T. As additional pressure is applied at end 61*b*, end 61*a* causes clevis 62 to move outward against spring 64 and anchor plate 63. Further pressure at end 61*b* forces spring 64 to compress and clamping bar 61 to rotate to a point where the center of said bar contacts the tree trunk. When pressure is released from end 61*b*, locking means 50 prevents the clamping bar from moving away from the trunk while spring 64 exerts a constant pressure against the clamping bar and tree trunk. As a result, the trunk is held firmly and securely within the tree stand.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. An adjustable tree stand for securing a tree in an upright vertical position comprising:

(a) a tree bracket in the form of a V-channel having an inner surface and a lower end and having complementary side notches disposed within said tree bracket for securing an upper leg-retaining plate and a lower leg-retaining plate thereto;

(b) a central leg member and first and second side leg members connected to said tree bracket by means of said upper leg-retaining plate and said lower leg-retaining plate;

(c) a clamping mechanism comprising a clamping arm mounted to one of said side leg members and engaging a locking means which is slidably mounted to the other of said side leg members; and (d) an upper-leg retaining plate and a lower leg-retaining plate, each of said upper-leg retaining plate and lower-leg retaining plate having a notched rear edge configured to cooperatively engage said complementary side notches within said tree bracket.

2. The adjustable tree stand according to claim 1, wherein said tree bracket further comprises a rim for supporting the trunk of a tree, said rim extending outwardly from said lower end of said inner surface.

3. The adjustable tree stand according to claim 1, wherein said clamping mechanism comprises a sliding angle bar having a first end and a second end, said first end slidably mounted to said first side leg member by means of a sliding clevis arrangement and said second end extending through a locking means which is slidably mounted to second said side leg member.

4. The adjustable tree stand according to claim 1, wherein said upper leg-retaining plate is in the form of a flat plate further comprising a front straight edge and a curved annular flange or bracket extending at a 90° angle therefrom and wherein said lower leg-retaining plate is in the form of a flat plate further comprising a front straight edge and a curved annular flange or bracket extending at a 90° angle therefrom.

5. The adjustable tree stand according to claim 4, wherein said upper leg-retaining plate and said lower leg-retaining plate further comprise complementary means for securing said central leg member and said side leg members therebetween.

6. The adjustable tree stand according to claim 4, wherein said central leg member and said side leg members are bolted between said upper leg-retaining plate and said lower leg-retaining plate.

7. The adjustable tree stand according to claim 4, wherein said upper leg-retaining plate and said lower leg-retaining plate further comprise means for limiting the rotation of said first and second side leg members.

8. The adjustable tree stand according to claim 7, wherein said means for limiting the rotation of said first and second side leg members includes a series of aperture/pin arrangements positioned about the periphery of both the upper leg-retaining plate and the lower leg-retaining plate.

9. The adjustable tree stand according to claim 7, wherein said means for limiting the rotation of said first and second side leg members includes a series of blisters positioned about the periphery of both the upper leg-retaining plate and the lower leg-retaining plate.

10. The adjustable tree stand accordingly to claim 1, wherein said clamping mechanism comprises a clamping arm having a first end and a second end, said first end pivotally secured to said first side leg member and said second end extending through a locking means which is slidably mounted to second said side leg member.

11. The adjustable tree stand according to claim 10, wherein said locking means is a ratchet-type lock.

12. The adjustable tree stand according to claim 10, wherein said locking means is configured in the form of a "P" having a long leg, a top leg and a bottom leg having a flat spring attached thereto.

13. A method of securely locating a tree in the adjustable tree stand according to claim 10, comprising:

(a) positioning the trunk of said tree against the inner surface of said tree bracket;

(b) pulling said second end of said clamping arm inwardly toward said trunk such that said slidably mounted locking means slides along said second side leg member toward said tree bracket until said clamping arm contacts said trunk; and (c) releasing said second end of said clamping arm such that said locking means is wedged tightly on said second side leg member.

14. The method according to claim 13, wherein said tree bracket further comprises a rim for supporting said trunk, said rim extending outwardly from said lower end of said inner surface.

* * * * *